United States Patent [19]

Biagini

[11] Patent Number: 4,785,639

[45] Date of Patent: Nov. 22, 1988

[54] COOLING SYSTEM FOR OPERATION IN LOW TEMPERATURE ENVIRONMENTS

[75] Inventor: Guido Biagini, Cherry Valley, Ill.

[73] Assignee: Sundstrand Corporation, Rockford, Ill.

[21] Appl. No.: 178,874

[22] Filed: Apr. 4, 1988

Related U.S. Application Data

[63] Continuation of Ser. No. 864,870, May 20, 1986, abandoned.

[51] Int. Cl.[4] ..... F25B 49/00

[52] U.S. Cl. ..... 62/132; 62/192; 62/DIG. 17

[58] Field of Search ..... 62/132, 192, 193, 472, 62/469, 503, 275, 276, DIG. 17, 160; 165/61, 63, 64, 29, 30

[56] References Cited

U.S. PATENT DOCUMENTS

| | | | |
|---|---|---|---|
| 3,082,610 | 3/1963 | Marlo | 62/DIG. 17 |
| 3,093,976 | 6/1963 | Walcutt | 62/DIG. 17 |
| 3,238,737 | 3/1966 | Shrader et al. | 62/DIG. 17 |
| 3,363,331 | 1/1968 | Barbier | 62/196 |
| 3,381,491 | 5/1968 | Harnish | 62/218 |
| 3,435,626 | 4/1969 | Wile et al. | 62/196 |
| 3,478,533 | 11/1969 | Kocher et al. | 62/DIG. 17 |
| 3,514,968 | 6/1970 | Kusuda et al. | 62/227 |
| 3,577,743 | 6/1971 | Long | 62/212 |
| 3,638,446 | 2/1972 | Palmer | 62/202 |
| 3,665,725 | 5/1972 | Barlass et al. | 62/196 |
| 3,757,530 | 9/1973 | Doyle et al. | 62/117 |
| 3,882,691 | 5/1975 | Baines et al. | 62/225 |
| 3,918,268 | 11/1975 | Nussbaum | 62/160 X |
| 3,938,349 | 2/1976 | Ueno | 62/197 |
| 4,066,869 | 1/1978 | Apaloo et al. | 62/472 X |
| 4,087,987 | 5/1978 | Schumacher et al. | 62/174 |
| 4,129,995 | 12/1978 | Usami | 62/217 |
| 4,208,883 | 6/1980 | Stirling | 62/192 |
| 4,333,317 | 6/1982 | Sawyer | 62/212 |
| 4,382,367 | 5/1983 | Roberts | 62/197 |
| 4,475,686 | 10/1984 | Huelle et al. | 62/212 |
| 4,523,435 | 6/1985 | Lord | 62/212 |
| 4,527,399 | 7/1985 | Lord | 62/212 |

*Primary Examiner*—Harry B. Tanner

*Attorney, Agent, or Firm*—Wood, Dalton, Phillips, Mason & Rowe

[57] ABSTRACT

Start-up problems in an intermittently operated evaporative cooling system to low temperature environments is avoided by the provision of one or more heaters 62, 64, 66 in the system. Typically the system will include an evaporator 10, a compressor 24, a condenser 42, a receiver 62 and an expansion valve 56. When low ambient temperatures reduce internal pressure within the system to a value below which it can be started through operation of the compressor 24, the heaters 62, 64, 66 may be energized to vaporize refrigerant and thus generate a pressure of sufficient magnitude so as to allow starting.

5 Claims, 1 Drawing Sheet

COOLING SYSTEM FOR OPERATION IN LOW TEMPERATURE ENVIRONMENTS

This application is a continuation of application Ser. No. 864,870, filed May 20, 1986, now abandoned.

FIELD OF THE INVENTION

This invention relates to an cooling system that may be called upon to operate in low temperature environments as, for example, evaporative cooling systems utilized for cooling electronics in air or space craft.

BACKGROUND OF THE INVENTION

The increasing use of electronics for any of a variety of purposes has naturally resulted in an increase in their use in relatively cold environments. Such environments may be earthbound environments but more commonly may be airborne environments in connection with the operation of air or space craft.

Even though modern day electronic systems require but a minor fraction of the power required by vacuum tubes to operate, because of their compactness, relatively high heat densities attend their operation. The heat generated by such operation must be transferred away from the electronic components to prevent the same from overheating and suffering damage or destruction. Not uncommonly, the heat generated by such electronic components is absorbed by the vaporization of a refrigerant. In the usual case, the cooling system will include an evaporator in heat exchange relationship with the electronic components which constitute the heat load. The evaporator will have an inlet and an outlet with the outlet being connected to a compressor which compresses vaporized refrigerant and provides the same to a condenser whereat it is condensed. The condensed refrigerant is then conveyed to a receiver and from the receiver through an expansion valve to the inlet of the evaporator. Evaporation takes place within the evaporator with the heat of vaporization being added to the refrigerant by the heat from the load.

When the system is in continuous operation, no particular difficulties in maintaining the operation are encountered. However, when operation of the system is intermittent, difficulty may be encountered in attempting to start up the system when the same has been subjected to low temperatures for a sufficient period of time so as to reach approximate temperature equilibrium with the environment.

In such a case, at the low temperature of the environment, the vapor pressure of the refrigerant may be so low as to make the system incapable of start-up. For with very low pressures, there will be little driving force to force liquid refrigerant through the expansion valve and at the same time, there will be very little mass for the compressor to compress to generate a sufficient pressure differential for operation.

The present invention is directed to overcoming the above problem.

SUMMARY OF THE INVENTION

It is the principle object of the invention to provide a new and improved cooling system. More specifically, it is an object of the invention to provide such a cooling system that is particularly adapted to intermittent operation and low temperature environments.

An exemplary embodiment of the invention includes a load to be cooled and an evaporator in heat transfer relation to the load. The evaporator has an inlet and an outlet, and the latter is connected to a compressor which receives vaporized refrigerant and compresses the same. A condenser is provided for receiving condensed vaporized refrigerant from the compressor in condensing the same. Also included is a receiver for receiving condensed refrigerant from the condenser. An expansion valve interconnects the receiver and the inlet to the evaporator. A heater is placed in the system and is operable to vaporize refrigerant to thereby generate pressure within the system to facilitate start-up thereof.

In a highly preferred embodiment of the invention, the heater is disposed in the receiver for vaporizing refrigerant therein.

The invention also contemplates that the heater can be placed in the evaporator or alternatively or conjunctively, in a sump typically associated with the compressor.

In a preferred embodiment, a pressure sensor is located in the system for controlling operation of the heater and preferably, heaters are employed in the receiver, in the evaporator, and in the sump of the compressor.

Other objects and advantages will become apparent from the following specification taken in connection with the accompanying drawings.

DESCRIPTION OF THE DRAWING

The FIGURE is a schematic of an cooling system made according to the invention.

DESCRIPTION OF THE PREFERRED EMBODIMENT

Figure 1:
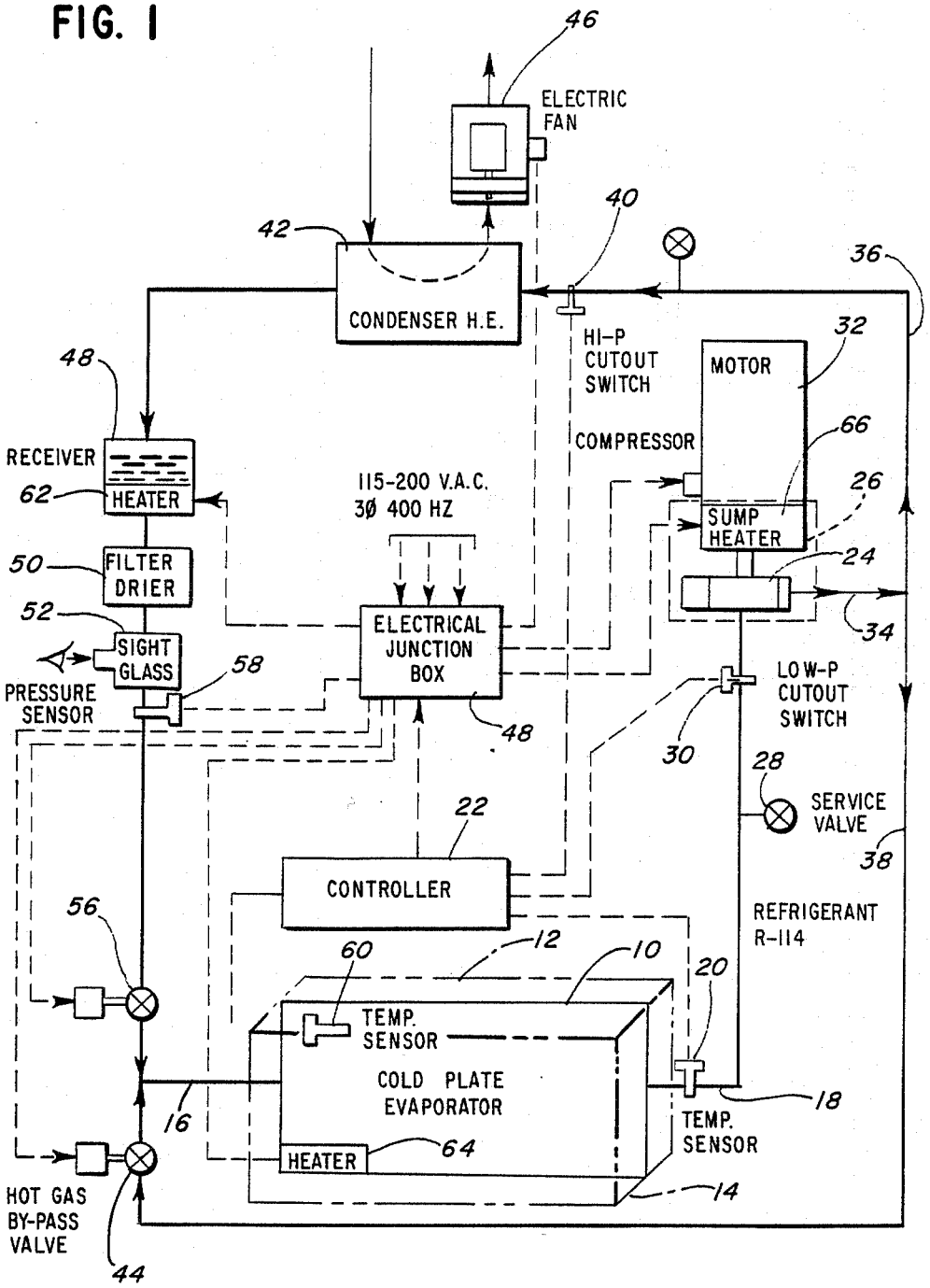

An exemplary embodiment is illustrated in the FIGURE and is seen to include a conventional cold plate evaporator 10. On opposite sides of the cold plate evaporator 10, as indicated in dotted lines, are heat loads 12 and 14 as, for example, electronic components.

The evaporator 10 includes an inlet 16 and an outlet 18, the latter including a temperature sensor 20. The temperature sensor 20 provides temperature information at the outlet of the evaporator to a conventional controller 22 which, as will be seen, ultimately controls the evaporative process so as to maintain the evaporator within the desired temperature range in spite of a varying heat load. The temperature sensor 20 preferably provides information to indicate that the vapor leaving the evaporator has a sufficient degree of superheat so as to prevent condensation of the same prior to receipt by a compressor 24 connected to the outlet 18. The compressor 24 is provided with a sump 26 as schematically illustrated in dotted lines.

Interposed between the outlet 18 and the compressor 24 is a service valve 28 through which additional refrigerant may be added to the system when required. There is also provided a pressure sensing switch 30 which is connected to the controller and is operative to ultimately prevent operation of the motor 32 which drives the compressor 24 in the event extremely low pressure indicative of a refrigerant leak is present.

The compressor 24 includes an outlet 34 that branches to lines 36 and 38. The line 36 passes through a high pressure sensing switch 40 to a condenser 42 whereat compressed vaporized refrigerant is condensed. The pressure sensing switch 40 is operative to halt system operation in the event that abnormally high pressure is sensed. Such a high pressure would be indicative of, for example, an obstruction to the flow of refrigerant within the system.

The line 38 is routed to a hot gas bypass valve 44 whose purpose will be explained hereinafter.

Returning to the condenser 42, an electric fan 46 is operated by the controller 22 via a junction box 48 to enhance heat transfer by flowing a fluid across the condenser 42.

Condensed refrigerant from the condenser 42 is directed to a conventional receiver 48. A conventional filter-dryer 50 and a sight glass 52 are located on the outlet side of the receiver and connected to an expansion valve 56 operated by the controller 22 via the junction box 48. A pressure sensor 58 is interposed between the sight glass 52 and the expansion valve 56. The sensor 58 is intended to provide the controller 22 with information relative to the pressure of the system and whether the same is sufficient for a normal start-up.

The valve 44 and the valve 56 are both connected to the inlet 16. The inlet side of the evaporator 10 is also provided with a temperature sensor 60 connected to the controller 22 which serves to determine heat loading on the evaporator 10.

According to the invention, the receiver 48 is provided with an electrically operated heater 62. A similar heater 64 is located near the inlet side of the cold plate evaporator 10 and finally, a similar heater 66 is disposed in the sum 26 of the compressor 24. In some systems, greater or lesser numbers of the heaters 62, 64 and 66 may be employed but there will generally always be a heater such as the heater 62 associated with the receiver 48.

The heaters 62, 64 and 66 are under the control of the controller 22. They are located in their respective system components so as to be at locations where refrigerant in the liquid phase, if present in the particular component at all, will be found. In response to a determination of low pressure from the pressure sensor 58, which low pressure is indicative of a system condition that will not facilitate start-up, the heaters 62, 64 and 66 are energized. This will in turn result in the vaporization of liquid refrigerant at the respective location; and this in turn will generate a vapor pressure system. At some point in time, the pressure will be evalated sufficiently so that the controller 22 will energize the compressor motor 32 to start operation of the system.

Once the system is in operation, the heaters 62, 64 and 66 will be de-energized and further operation will be conventional. Further, if start-up is required in the instance where the environment is not so cold as to pose a difficulty during start-up, the pressure within the system will be sufficient to allow normal start-up without use of the heaters 62, 64 and 66 and this information will be conveyed to the controller by the pressure sensor 58.

The amount of refrigerant being evaporated in the evaporator 10 will be controlled by the controller 22 via the valve 56. In partial load situations, where admission solely of condensed refrigerant to the evaporator 10 could result in a liquid phase refrigerant exiting the evaporator via the outlet 18, the lack of superheat will be sensed at the temperature sensor 20 and the controller may cause the hot gas bypass valve 44 to open. This will result in hot compressed gas from the compressor 34 being supplied to the inlet 16 to the evaporator along with condensed refrigerant so as to increase the temperature of the effluent refrigerant at the outlet 18 to the desired superheated level.

From the foregoing, it will be appreciated that a system made according to the invention is susceptible to use in a wide variety of environments including relatively cold ones without being affected by start-up problems when intermittent operation is required.

I claim:

1. A cooling system subject to operation in low temperature environments comprising:

a load to be cooled;

an evaporator in heat transfer relation to said load and having an inlet and an outlet;

a compressor connected to said outlet for receiving vaporized refrigerant and compressing the same;

a condenser for receiving compressed vaporized refrigerant from said compressor and condensing the same;

a receiver for receiving condensed refrigerant from said condenser;

an expansion valve interconnecting said receiver and said inlet;

a first heater in said evaporator for vaporizing refrigerant in said evaporator to thereby generate a pressure within said system to facilitate operation thereof; and a second heater in said receiver for vaporizing refrigerant therein to generate a pressure sufficient to enable said system to initiate operation.

2. A cooling system subject to operation in low temperature environments comprising:

a load to be cooled;

an evaporator in heat transfer relation to said load and having an inlet and an outlet;

a compressor connected to said outlet for receiving vaporized refrigerant and compressing the same and including a sump;

a condenser for receiving compressed vaporized refrigerant from said compressor and condensing the same;

a receiver for receiving condensed refrigerant from said condenser;

an expansion valve interconnecting said receiver and said inlet;

heaters in said receiver and said sump for vaporizing refrigerant therein to generate a pressure sufficient to enable said system to initiate operation; and an additional heater in said evaporator for vaporizing refrigerant therein to generate a pressure sufficient to enable said system to initiate operation.

3. The system of claim 2 further including a pressure sensor in said system for controlling operation of said heaters.

4. A cooling system subject to operation in low temperature environments comprising:

a load to be cooled;

an evaporator in heat transfer relation to said load and having an inlet and an outlet;

a compressor connected to said outlet for receiving vaporized refrigerant and compressing the same;

a condenser for receiving compressed vaporized refrigerant from said compressor and condensing the same;

a receiver for receiving condensed refrigerant from said condenser;

an expansion valve interconnecting said receiver and said inlet; and a heater in said evaporator for vaporizing refrigerant therein to generate a pressure sufficient to enable said system to initiate operation.

5. A cooling system subject to operation in low temperature environments comprising:

a load to be cooled;

an evaporator in heat transfer relation to said load and having an inlet and an outlet;

a compressor having a sump connected to said outlet for receiving vaporized refrigerant and compressing the same;

a condenser for receiving compressed vaporized refrigerant from said compressor and condensing the same;

a receiver for receiving condensed refrigerant from said condenser;

an expansion valve interconnecting said receiver and said inlet;

a heater in said sump for vaporizing refrigerant therein to generate a pressure sufficient to enable said system to initiate operation; and an additional heater in said evaporator for vaporizing refrigerant therein to generate a pressure sufficient to enable said system to initiate operation.

* * * * *